United States Patent [19]

Nakamura

[11] Patent Number: 4,807,801

[45] Date of Patent: Feb. 28, 1989

[54] METHOD OF AMELIORATING THE RESIDUAL STRESSES IN METALLIC DUPLEX TUBES AND THE LIKE AND APPARATUS THEREFOR

[75] Inventor: Hitoshi Nakamura, Yokohama, Japan

[73] Assignee: Ishikawajima-Harima Heavy Industries Co., Ltd., Tokyo, Japan

[21] Appl. No.: 114,336

[22] Filed: Oct. 28, 1987

[30] Foreign Application Priority Data

Oct. 28, 1986 [JP] Japan ..... 61-256589

[51] Int. Cl.[4] ..... C21D 1/00; C21D 9/08

[52] U.S. Cl. ..... 228/231; 148/127; 148/131; 219/8.5; 219/61.2; 219/243

[58] Field of Search ..... 228/231, 222, 127, 131, 228/200; 148/127, 131, 136, 137; 219/61.2, 61.7, 8.5, 243; 29/33 D

[56] References Cited

U.S. PATENT DOCUMENTS

| | | | |
|---|---|---|---|
| 4,449,281 | 5/1984 | Yoshida et al. | 228/127 |
| 4,608,101 | 8/1986 | Umemoto | 148/127 |
| 4,726,856 | 2/1988 | Tanaka | 148/127 |
| 4,731,131 | 3/1988 | Sakata et al. | 148/127 |

FOREIGN PATENT DOCUMENTS

| | | | |
|---|---|---|---|
| 226118 | 12/1984 | Japan | 148/131 |
| 194116 | 8/1986 | Japan | 148/131 |
| 308077 | 8/1971 | U.S.S.R. | 148/127 |

*Primary Examiner*—Nicholas P. Godici
*Assistant Examiner*—Samuel M. Heinrich
*Attorney, Agent, or Firm*—Cullen, Sloman, Cantor, Grauer, Scott & Rutherford

[57] ABSTRACT

A method of ameliorating the residual stresses in a metallic duplex tube and the like and an apparatus therefor, wherein the duplex tube includes a main tube defining the outer tube, and a thermal sleeve defining the inner tube which is inserted to the outer tube, the thermal sleeve being welded onto the inside of the main tube at its root. The method comprises the steps of supplying cooling water in the duplex tube; fitting a restraining ring externally onto the outer surface of the main tube at a position corresponding to the thermal sleeve root; and heating the main tube from its outer surface so as to generate a temperature difference across the main tube wall. The apparatus thereof comprises a cooling water feeding means for supplying the cooling water in the double tube; a restraining ring fitted externally onto the outer surface of the main tube at a position corresponding to the thermal sleeve root; and heating means for heating the main tube from its outer surface so as to generate a temperature difference across the main tube wall.

7 Claims, 8 Drawing Sheets

| Equi-stress Lines and Stresses | |
|---|---|
| 1 | -40 |
| 2 | -30 |
| 3 | -20 |
| 4 | -10 |
| 5 | 0 |
| 6 | 10 |
| 7 | 20 |
| 8 | 30 |
| MAX = | 43.34 |
| MIN = | -43.32 |

| Equi-stress Lines and Stresses | |
|---|---|
| 1 | -40 |
| 2 | -30 |
| 3 | -20 |
| 4 | -10 |
| 5 | 0 |
| 6 | 10 |
| 7 | 20 |
| 8 | 30 |
| 9 | 40 |
| MAX = | 47.75 |
| MIN = | -43.63 |

| Equi-stress Lines and Stresses | |
|---|---|
| 1 | -20 |
| 2 | -15 |
| 3 | -10 |
| 4 | - 5 |
| 5 | 0 |
| 6 | 5 |
| 7 | 10 |
| 8 | 15 |
| 9 | 20 |
| 10 | 25 |
| 11 | 30 |
| 12 | 35 |
| 13 | 40 |
| 14 | 45 |
| MAX = | 51.95 |
| MIN = | -28.95 |

METHOD OF AMELIORATING THE RESIDUAL STRESSES IN METALLIC DUPLEX TUBES AND THE LIKE AND APPARATUS THEREFOR

BACKGROUND OF THE INVENTION

1. Field of Invention

This invention relates to a method of ameliorating the residual stresses in metallic duplex tubes and the like (hereinafter, "pipe" will be used for the generic terms "tubing" and "tube," and the term "double pipe" will be used for "duplex tube") and an apparatus therefor, each of the metallic double pipes being made of either the same austenitic stainless steel or different one (in either case, referred to as "austenitic stainless steel" hereinafter). In particular, this invention is concerned with a method of ameliorating the residual stress occurring in the vicinity of the weldment that joins the internal surface of the outer pipe, or the main pipe, and the inner pipe, or the thermal sleeve inserted into the outer pipe, as well as the apparatus therefor.

2. Description of the Prior Art

It is known that in austenitic metallic materials, such as austenitic stainless steel or the like that are often used in nuclear plants and chemical plants, stress corrosion cracking (referred to as "SCC" hereinafter) takes place rapidly under the simultaneous presence of tensile stress and a corrosive environment. It is also known that, since SCC takes place only when three factors, namely, the austenitic structure, the tensile stress, and the corrosive environment, are simultaneously present, SCC can be prevented by ameliorating any of these three. Here, it is to be noted that, even though the austenitic structure and the corrosive environment are subject to service requirements and are thus difficult to change, the tensile stress may be ameliorated by modifying the processing method.

In the conventional method of ameliorating the residual stress in a seamed pipe of austenitic stainless steel, the outer surface of the pipe is induction-heated while the inner surface is cooled by water so as to give rise to a temperature difference across the pipe wall that will produce a thermal stress exceeding the yield strength of the steel. This provides a way of ameliorating the residual stress by producing a residual compressive stress at the inner side of the seamed portion of the pipe and thereabout, where the residual tensile stress is apt to occur.

Although the above-mentioned treatment method is suited for austenitic stainless steel pipes of simple forms, such as straight pipes, it has been found unsuitable for use with a complex form such as a double pipe, consisting of a main pipe as the outer pipe and a thermal sleeve as the inner pipe, the root of the latter being welded to the inside of the former. This is because, since the thickness of the part where the main pipe and the thermal sleeve are welded together becomes far greater than that of the main pipe itself, the temperature distribution in the main pipe, produced by the induction heating mentioned above, becomes uneven, and the magnitude and the direction of stress generated by such temperature difference deviate from what was intended.

Also, there is a danger that the neighboring parts of the thermal sleeve root weldment may become partially sensitized by the welding heat, making them worse rather than better by the treatment.

SUMMARY OF THE INVENTION

This invention was developed in order to solve the problems associated with the conventional method. One of its objects is to give rise to a compressive stress in the vicinity of the weldment of the inner pipe root by preventing the thermal expansion of the outer pipe at its parts near the inner pipe root while performing the residual stress amelioration treatment on the parts of the outer pipe in the vicinity of the weldment.

According to this invention, into the cylindrical space between the main pipe (the outer pipe) and the thermal sleeve (the inner pipe) whose root is welded to the former, cooling water is supplied by a cooling water feeding means. Then, the main pipe is induction-heated from the outside by a heating means with a restraining ring fitted on the outer surface of the main tube at a position corresponding to the thermal sleeve root. Consequently, a desired temperature difference is obtained across the main pipe wall in the direction of its thickness.

The induction heating raises the temperature of the main pipe, but hardly raises the temperature of the thermal sleeve. Therefore, without the restraining ring, a differential thermal expansion takes place between the main pipe and the thermal sleeve, so that a compressive stress that is unfavorable for amelioration of residual stress may result at the junction of the two, or in the thermal sleeve root. According to the invention, on the other hand, a restraining ring is fitted to the main pipe on its outer surface at a position corresponding to the thermal sleeve root part so as to repress the thermal expansion of the main pipe proper. Owing to this device, the occurrence of unfavorable residual stress in the thermal sleeve root during heating is obviated, and, even if residual stress is produced, it is far less than the yield point of the material.

Furthermore, owing to the temperature difference generated between the inner and the outer surfaces of the main pipe excepting that part which corresponds to the thermal sleeve root, a tensile stress that exceeds the yield point is generated in the inner surface of the main pipe. When the main pipe is cooled to ordinary temperature, a compressive stress is imposed on the main pipe.

DESCRIPTION OF THE PREFERRED EMBODIMENTS

Figure 1:
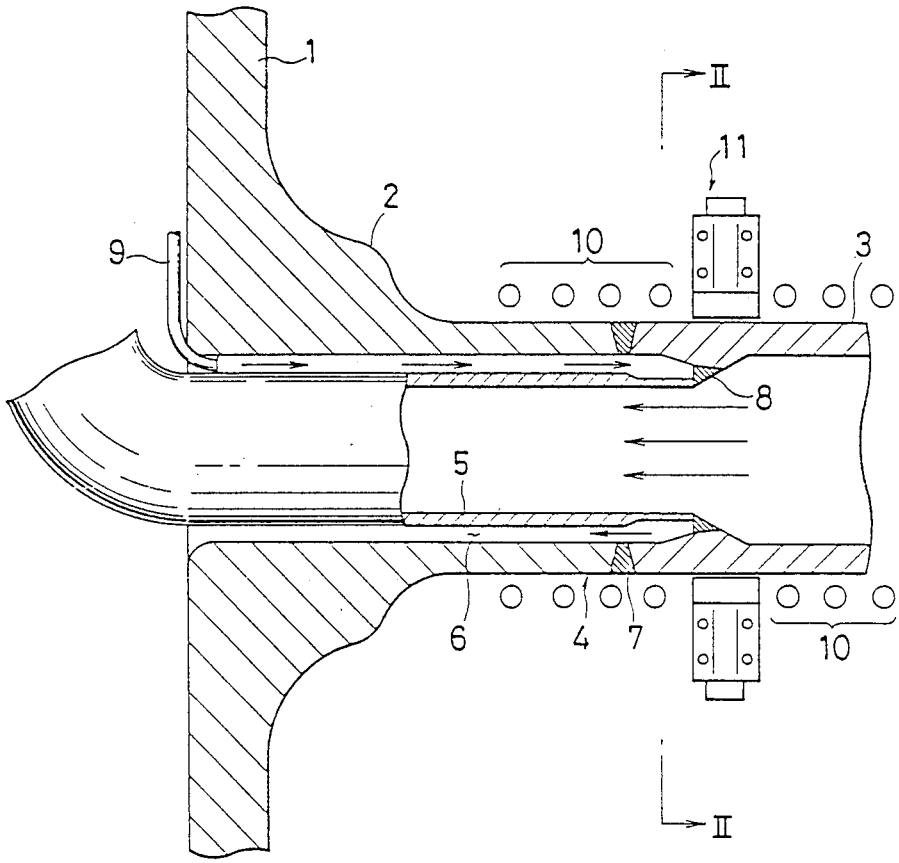
FIG. 1 is a longitudinal section view, showing an embodiment of the method of ameliorating the residual stress in a metallic double pipe and the like of this invention when applied to a nozzle of the nuclear reactor pressure vessel.

The method of ameliorating the residual stress in metallic double pipes and the like of the present invention will first be disclosed with reference to the attached drawings. In one embodiment, as shown in FIG. 1, a metallic double pipe is provided in a nuclear reactor pressure vessel 1 by a main pipe 4, which is composed of a nozzle 2, a safe end 3, and a thermal sleeve 5 that is inserted to the main pipe 4, thereby forming a tubular space 6 between the main pipe 4 and the thermal sleeve 5.

The two components of the main pipe 4 are mutually joined in their longitudinal directions by butt welding at weldment 7 (the welded joint), and the root of the thermal sleeve 5 is welded to the inner surface of the main pipe 4 at weldment 8. In this embodiment, the double pipe is made of a type 304 austenitic stainless steel.

The apparatus used for amelioration of the residual stress, on the other hand, consists of a water feeding nozzle 9 for supplying cooling water into the tubular space 6 so as to form a flow of water therethrough, a heating means 10 for performing induction heating by supplying high frequency current to the coil, and a restraining ring 11, which will be described below.

Figure 2:
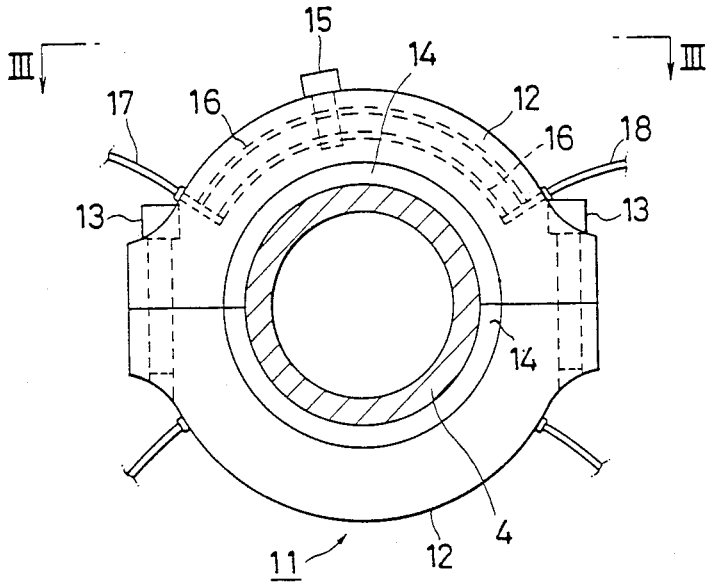
FIG. 2 is a cross-sectional view taken along the line II—II in FIG. 1, showing the constraining of the main pipe by means of a restraining ring.
Figure 3:
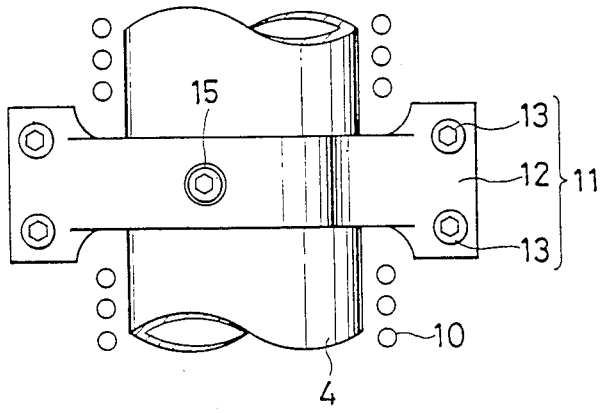
FIG. 3 is a cross-sectional view taken along the line III—III in FIG. 2.

The restraining ring 11 comprises, as shown in FIGS. 1-3, a load-bearing ring 12 of divisible construction disposed around the main pipe 4, a pair of connecting bolts 13 to assemble the ring 12, a circular metal washer 14 which is made of several segments and is disposed between the main pipe 4 and the ring 12, an adjusting bolt 15 that adjusts the degree of constraint (namely, the pressure of contact) the metal washer 14 applied to the main pipe 4, a cooling water channel 16 that is formed within the ring 12, and a cooling water inlet 17 and outlet 18 to supply cooling water into the channel 16 so as to keep the ring 12 cooled. To the cooling water inlet 17 there is connected a cooling water source (not shown).

The procedure of performing residual stress amelioration treatment on the butt welded part (welded joint) 7 of the main pipe 4 (that part in FIG. 1 over which the heating means 10 is deployed with the root of the thermal sleeve 5 as the center) will now be described. Into the internal spaces of the double pipe, namely into the main pipe 4 and into the thermal sleeve 5 inserted therein, cooling water is supplied by an appropriate water feeding means (not shown) so as to fill them. Then, the tubular space 6 formed between the main pipe 4 and the thermal sleeve 5 is also filled with cooling water, but preferably so that the cooling water flows as indicated by arrows in FIG. 1, even prior to heating the main pipe 4. This measure is taken because if the thickness of the space 6 is small in the radial direction of the double pipe, the cooling water in the tubular space 6 may remain stagnated since it may be influenced very little by the water flowing in the thermal sleeve 5.

In order to avoid the situation described above, the tip of a small water feeding nozzle 9 is disposed in the space 6 to inject water toward the root of thermal sleeve 5 as well as the safe end 3 so that water fills up the tubular space 6. Thus, this localized water flow will spread upon colliding the root of thermal sleeve 5, creating a water flow in a tangential direction.

The cooling water is kept flowing both in the thermal sleeve 5 and in the tubular space 6, and the restraining ring 11 is held by the connecting bolts 13 in a preselected position, in which the outer surface of the ring 11 is disposed over the root weldment 8 of the thermal sleeve 5, so that the metal washer 14 may be brought into close contact with the main pipe 4 by the adjusting bolt 15 so as to prevent expansion of the contacting portions. With cooling water flowing in the cooling water channel 16 of the restraining ring 11, the heating means 10 is activated by feeding current to the induction heating coil so as to heat the main pipe 4 in the vicinity of the butt welded joint 7.

As the main pipe 4 is thusly heated, the internal temperature of the wall of the main pipe 4 is raised, creating a temperature distribution such that the temperature is higher at the outer surface and lower at the inner surface. Here, the inner and outer surfaces of the thermal sleeve 5 are kept at a low temperature due to the cooling water.

When the main pipe 4 is heated as described above, thermal expansion of the thermal sleeve 5 and the vicinity of its root is repressed due to the presence of the restraining ring 11 on the outer surface of the main pipe 4 and the cooling thereof by the cooling water supplied therein through the channel 16. For this reason, these portions undergo a deformational change, from the solid line configuration to that of the double-dotted line shown in FIG. 4.

Because the main pipe 4 is always in contact at its inner surface with cooling water, which is constantly moving due to the local flow of water from the nozzle means 9 or due to the convective ascending flow caused by heating, its inner surface is held to below boiling temperature. With the main pipe 4 kept in this state, it is possible to generate a thermal stress on its surface in excess of the yield strength by heating the outer surface in excess of the yield strength by heating the outer surface of the pipe 4 by means of the heating means 10 so as to create a large temperature difference across the wall (for example, 200 degrees C. or more for austenitic stainless steel).

As long as the cooling water is flowing in the tubular space 6, the inner surface temperature of the main pipe 4 does not become excessively high. This is because, even if steam is generated in the tubular space 6 upon heating, the local water stream is injected into the steam collecting in an upper portion, accomplishing effective cooling, on one hand, and because this steam does not get entrapped since it is continually removed out and away from the uppermost portion, on the other hand. Therefore, the inner surface temperature of the main pipe 4 is held low, for example, below boiling temperature.

Heating is continued for a period long enough to give rise to a temperature difference of 200 degrees C. or more and to provide a stress in excess of yield strength in the neighboring parts of the safe end 3, inclusive. Then the heating means 10 is deactivated, and the whole assembly is left naturally cooled until its temperature reaches room temperature. In the meantime, the main pipe wall restores to a state of approximately even temperature distribution at a temperature, for example, of the cooling water (ordinary temperature) under transfer of heat such as by cooling water and by the safe end 3. When thusly cooled, the objective parts of the treatment, namely the internal surfaces of the main pipe 4 in the vicinity of the safe end 3, which may be, for example, the internal surfaces neighboring the butt welded joint 7 in FIG. 1, can be brought to a state wherein a compressive residual stress has been given thereto.

Figure 5:
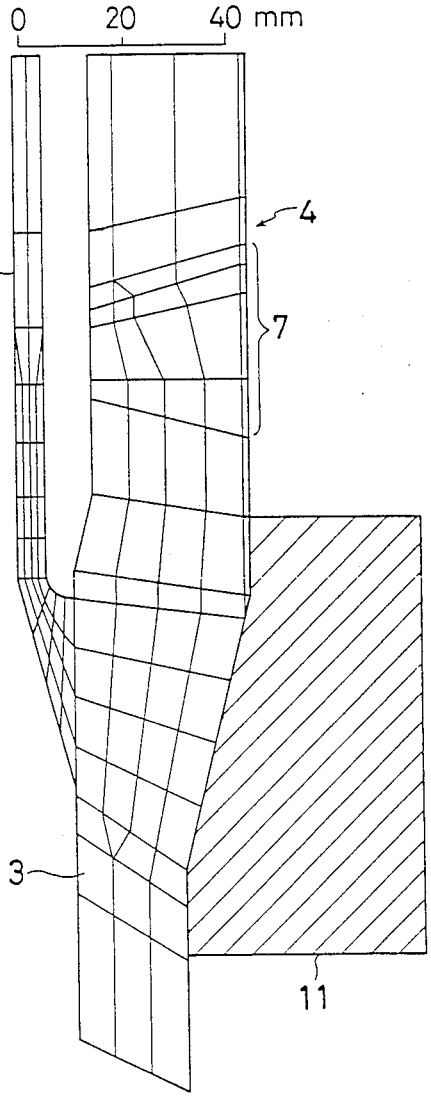
FIG. 5 is a diagram showing a model for analyzing by the finite element method (FEM) the case of performing the residual stress amelioration treatment with the restraining ring closely installed.

FIG. 5 shows an FEM analysis model for the aforementioned embodiment, where the heating means 10 is activated with the restraining ring 11 closely fitted onto the main pipe 4. A scale representing the actual parts is also shown in FIG. 5, as well as in FIGS. 6 through 8.

Figure 6:
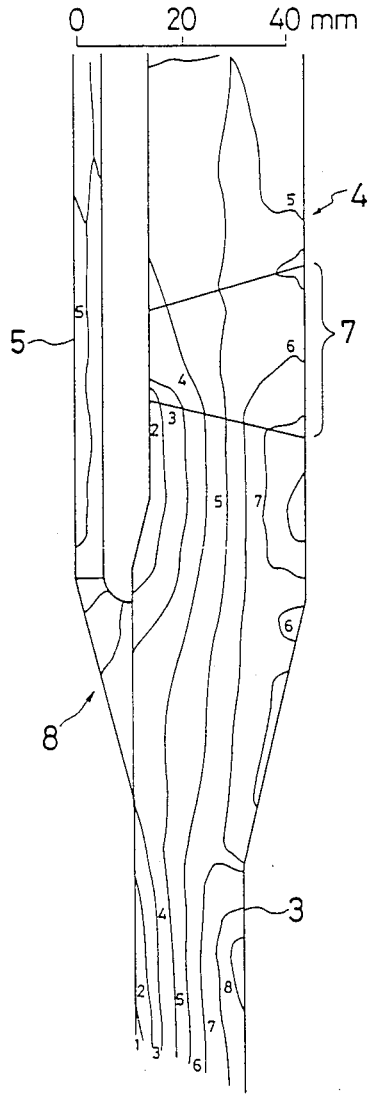
FIG. 6 is a diagram showing the axial residual stress distribution profiles when the residual stress amelioration treatment has been performed with the restraining ring fitted on, accompanied by a table identifying equi-stress profile lines and their magnitudes of stress by numerical figures, together with the maximum and the minimum values of the residual stress.

FIG. 6 shows the results of calculating the axial residual stresses after having performed the residual stress amelioration treatment corresponding to FIG. 5, where the stress distribution is as presented in the table accompanying the figure. For example, the profile line 3 (small numeral in the table) is the equi-residual stress line for $-20$ kgf/mm$^2$, the minus sign meaning compression, while plus represents tension. This convention is followed also in FIGS. 7 and 8.

Figure 7:
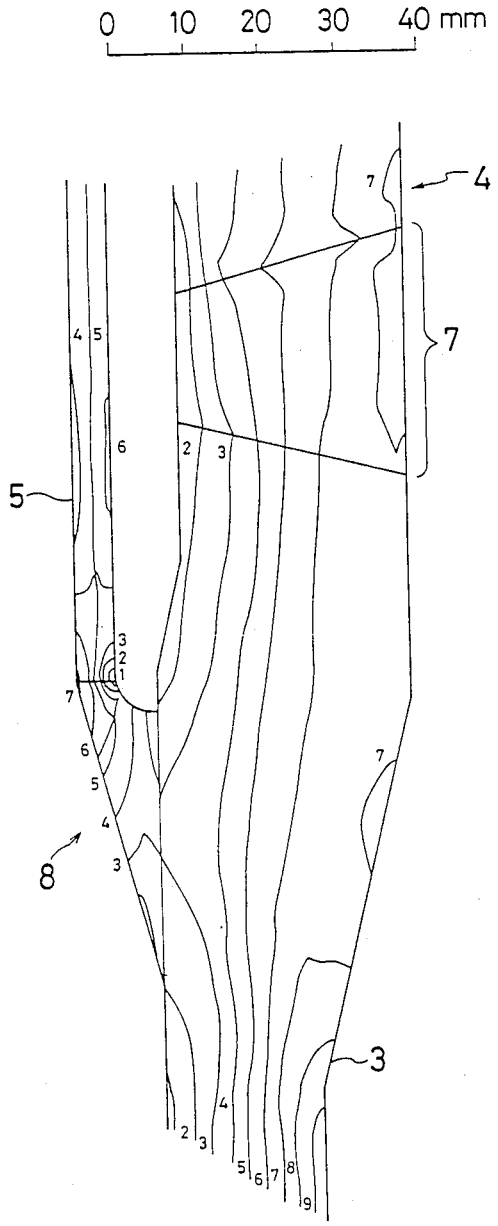
FIG. 7 is a diagram showing the axial residual stress distribution profiles when the residual stress amelioration treatment has been performed without the restraining ring, accompanied by a table of the same nature as in FIG. 6.

FIG. 7, on the other hand, shows the case of conducting the residual stress amelioration treatment without the restraining ring 11 in FIG. 5.

Examination of these results reveals that, in the case of FIG. 6, such compressive residual stresses as represented by equi-stress lines 2 to 4 can be generated in the places where residual stress amelioration is intended, namely in the inside of the main pipe in the vicinity of the butt welded joint 7. It is to be noted also that in the root part of the thermal sleeve 5 and the weldment 8, the state of compressive residual stress or zero stress prevails as represented by lines 4 and 5.

The effects of residual stress amelioration shown in FIG. 6 are further clarified when compared with FIG. 7. That is to say, even without the restraining ring, it is still possible to give rise to residual stresses as large as the equi-stress line 2 in the places where stress amelioration is intended, namely in the vicinity of butt welded joint 7, but the weldment 8 of thermal sleeve 5 is left with stresses that vary greatly from compressive to tensile as represented by lines 1 to 7. Particularly, the presence of a tensile residual stress as large as 20 kgf/mm$^2$ shown by line 7 suggests, together with the thermal effects left in the neighborhood of root weldment 8 by welding, a possibility of this part becoming defective during service.

Figure 8:
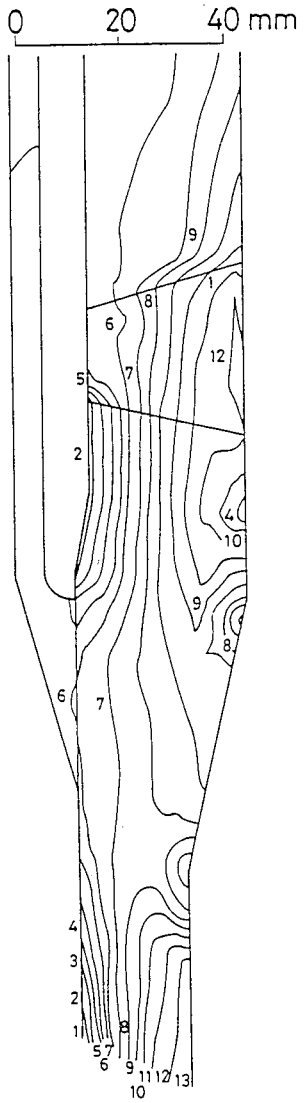
FIG. 8 is a diagram showing the circumferential residual stress distribution profiles when the residual stress amelioration treatment has been performed with the restraining ring installed, accompanied by a table of the same nature as in FIG. 6.

In the heat-affected zones of butt welded joint 7 of main pipe 4 and root weldment 8 of thermal sleeve 5, the presence of axial tensile residual stress likely leads to corrosion cracking and other defects, in the presence of a corrosive environment as mentioned earlier. This problem has been examined for circumferential residual stress, as seen in FIG. 8. The result indicates that the residual stress is either compressive or zero, as represented by lines 2 to 5, which means that there is no such problem.

Figure 4:
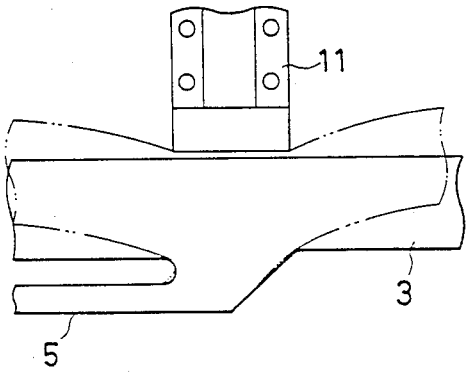
FIG. 4 is a schematic view, depicting deformation occurring in the vicinity of the restraining ring when the main pipe is induction-heated with the restraining ring installed.
Figure 9:
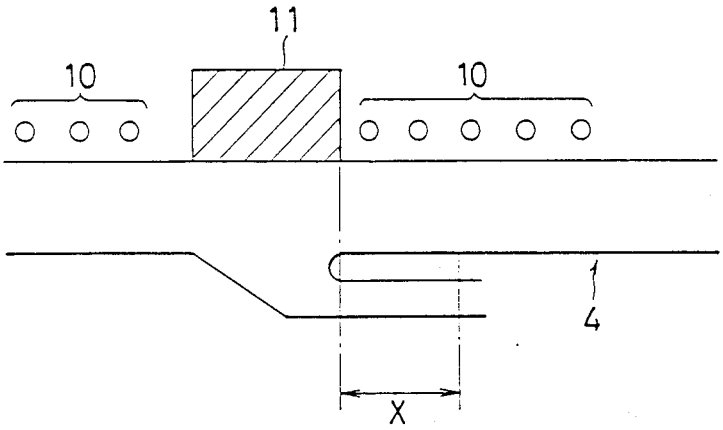
FIG. 9 is a cross-sectional view to aid in examining the changes in the stress due to the repression imposed by the restraining ring as a function of the distance therefrom.
Figure 10:
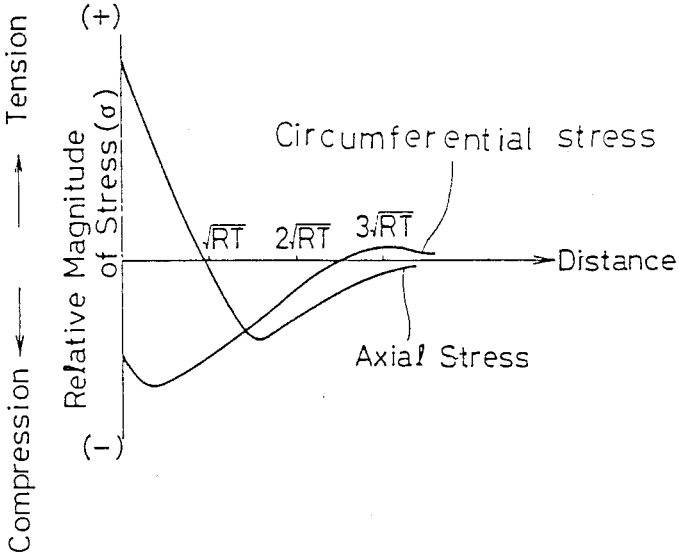
FIG. 10 is a plot of the stresses generated at the inner surface of the main pipe under constraint based on the view shown in FIG. 9.

The effects of the position of the restraining ring 11 in repressing the expansion of the main pipe 4, shown in FIG. 4, on the residual stress amelioration at the main pipe inner surface have been studied. FIGS. 9 and 10 show the coordinates and results of calculating, by means of the ring and shell theory, stress distributions in axial and circumferential directions generated in the inner surface of the main pipe 4 at distance X from the end of the restraining ring 11, for the case of heating the pipe 4 to a uniform temperature, which is similar to a case where the pipe 4 is heated in atmosphere. Here, R is the neutral radius of the main pipe 4, and t is its wall thickness.

As mentioned earlier, it is necessary for the main pipe 4 to have a temperature difference across its wall such that it is higher at the outer surface and lower at the inner surface in order to carry out the residual stress amelioration. In this way, the inner surface of the main pipe 4 is finally left with a compressive stress after the stress amelioration treatment owing to the the resulting stress distribution in the main pipe 4, compression at the outside and tension at the inside, and the fact that these stresses have been given so as to exceed the yield point of the material.

In searching FIGS. 9 and 10 for a state that is favorable to generate the tensile stress in the inner surface of the main pipe, it will be seen in the axial direction that the stress is tensile for $X<1.0\sqrt{Rt}$, becoming compressive in the range of $1.0\sqrt{RT}<X<2.5\sqrt{Rt}$, where the magnitude of the stress therefore has to be carefully controlled.

In the tangential direction, on the other hand, the stress is compressive for $X<2\sqrt{Rt}$.

Therefore, it may be concluded from these conditions that operations which will produce heat-affected zones in the butt welded joint 7 for $X>2.5\sqrt{Rt}$ should entail a satisfactory residual stress amelioration for the inner surface of the main pipe 4 as well as the thermal sleeve root 5.

Calculations have been conducted for the model shown in FIGS. 9 and 10 with values obtained in actual cases as follows:

| | |
|---|---|
| Neutral radius of main pipe | R = 153 mm |
| Wall thickness of main pipe | t = 31.5 mm |
| Outer surface temperature | $T_1$ = 550 degrees C. |
| Inner surface temperature | $T_2$ = 120 degrees C. |
| Initial temperature | $T_0$ = 40 degrees C. |
| Mean temperature rise | |
| $\Delta T = (T_1 + T_2)/2 - T_0$ = 295 degrees C., | |
| Young's modulus | E = 20,000 kgf/mm$^2$ |
| Poisson ratio | $\nu$ = 0.3 |
| Thermal expansion coefficient | $\alpha = 1.6 \times 10^{-5}$/degrees C. |

Figure 11:
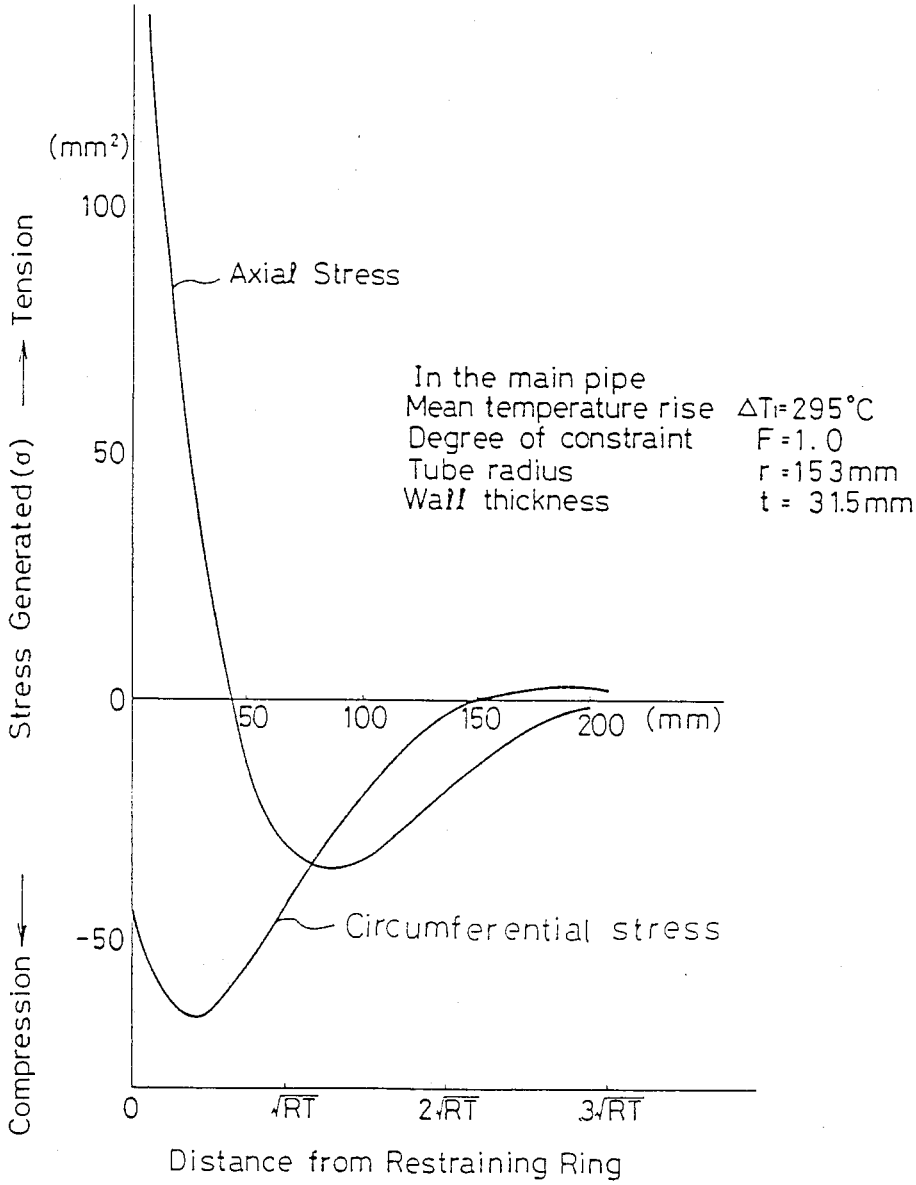
FIG. 11 is a plot of the distribution of stresses generated at the inner surface of the main pipe under constraint, as calculated based on FIGS. 9 and 10.

FIG. 11 shows the results of calculations conducted for an assumption that the restraining ring completely suppresses the radial expansion or a constraint factor F=1.0.

It will be seen that a compressive stress of as large as 65 kgf/mm$^2$ is generated in the neighborhood of $X=0.5\sqrt{Rt}$. As 100% suppression is difficult with actual restraining rings, this value may be discounted.

Thus, for a suppression of 80%, $-65$ kgf/mm$^2$ $\times 0.80 = -52$ kgf/mm$^2$.

On the other hand, the stress $\sigma$ generated by the temperature difference across the main pipe wall upon residual stress amelioration treatment is approximately given by the following equation.

$$\sigma = E \cdot \alpha \cdot \Delta T/\{2(1-\nu)\} = 20{,}000 \times 1.6 \times 10^{-5} \times (550-120)/\{2(1-0.3)\} = 98 \text{ kgf/mm}^2,$$

Thus, the circumferential residual stress $\sigma$ of the main pipe at its inner surface (where $X=0.5\sqrt{Rt}$) is $$\sigma = 98 - 52 = 46 \text{ kgf/mm}^2$$

Here, since the yield strength of stainless steel is $\sigma y = 25$ kgf/mm$^2$, it is $\sigma >> \sigma y$, meaning that this part yields in the tensile direction upon heating, resulting in a compressive stress at the completion of cooling.

In the axial direction, on the other hand, the residual compressive stress becomes the greatest at about $X=1.4\sqrt{Rt}$. Since this is some 40% smaller than the circumferential stress, however, these stresses do not present much of a problem for amelioration of axial residual stress.

It is to be appreciated from the foregoing that presence of the restraining ring does not adversely affect the stress amelioration treatment conducted on the main pipe. However, in order to perform the treatment with comparative ease, the distance between the welded joint and the restraining ring, X, should preferably be greater than $2.5\sqrt{Rt}$ as mentioned earlier, where the condition for heating is $$\Delta T \geqq 4 \cdot \sigma \cdot (1-\nu)/E \cdot \alpha, \text{ and}$$

$$\tau \geqq 0.7 \cdot h_1^2/a,$$

where $\tau$ is the heating time, $h_1$, the plate thickness, and a, the thermal diffusivity.

If circumstances demand that X be smaller than $2.5\sqrt{Rt}$, however, a margin should be given to the residual stress amelioration treatment in consideration of the compressive stress the restraining ring generates.

In place of or in addition to the above-described embodiments, various other embodiments are possible, such as:

(1) in heating the main pipe to generate the temperature difference, control the surface temperatures of the main pipe and the safe end to be both 550 degrees C. or below, so that no sensitized regions form in the structure of the outer surface of the main pipe;

(2) conducting the treatment with the cooling water stagnated in the thermal sleeve, while forming in essence a convective water flow, while taking into account operating factors as the size of the double pipe, depth of induction heating, quantity of heat of induction heating, time of induction heating, and the value set for the temperature difference across the main pipe wall thickness;

(3) when the root of the thermal sleeve is located vertically lowest or bottomed in terms of a double pipe or when an autoconvection of cooling water takes place in the tubular space during heating, the water feeding nozzle means need not be used; and (4) applying the principles of this invention to a double pipe made of austenitic metals other than the austenitic stainless steel.

As described above, in the method of ameliorating the residual stresses in a metallic double pipe and the like of this invention, cooling water is supplied inside the double metal pipe, which is constituted by welding a thermal sleeve by its root onto the inner surface of the main pipe, the thermal sleeve being inserted into the main pipe, and the main pipe being heated from outside with a restraining ring fitted on the outer surface of the main pipe at a place corresponding to the aforesaid thermal sleeve root, so as to generate a thermal difference across the main pipe wall.

Because of this method, therefore, this invention has the following advantages:

(1) In conducting the residual stress amelioration treatment by induction heating the main pipe, no large dimensional difference appears between two portions of the main pipe, namely a portion where its temperature is held low, and hence is prevented from thermal expansion, by the cooling water and a portion where the restraining ring is fitted on; consequently, adverse effects upon the induction heating of the main pipe can be avoided.

(2) Because of the contraction of the main pipe wall that has thermally expanded upon the induction heating to exceed the yield point, the thermal sleeve root is compressed so that a residual compressive stress is generated in the thermal sleeve root.

(3) Since the amelioration treatment can be applied independently from the thermal sleeve root to the welded joint, which is located spacedly apart from the thermal sleeve root, the method of this invention is easy to perform and enjoys a high degree of practicality.

We claim:

1. A method of ameliorating the residual stress in a metallic double pipe and the like, comprising the steps of:

(a) supplying cooling water inside the double pipe which includes a main pipe defined by an outer tube, and a thermal sleeve defining an inner pipe inserted into said main pipe, said thermal sleeve being welded to said main pipe at the root of said sleeve;

(b) fitting a restraining ring externally onto the outer surface of said main pipe at a position corresponding to said thermal sleeve root; and (c) heating said main pipe from its outer surface so as to generate a temperature differential in said main pipe in the direction of its wall thickness.

2. The method of claim 1, including the step of controlling the outer surface temperature of said main pipe to a temperature of 550 degrees C. or less so as not to create any sensitized regions in the metal structures of the outer surface of said main pipe.

3. The method of claim 1 including the step of circulating the cooling water by convection in order to prevent the temperature of said cooling water from rising.

4. The method of claim 1 wherein step (a) is performed by supplying said cooling water in the cylindrical space between said main pipe and said thermal sleeve so as to produce a water flow therein.

5. An apparatus for ameliorating the residual stresses in a metallic double pipe or the like and of the type including a main pipe defined by an outer tube, and a thermal sleeve defined by an inner tube inserted into said main pipe, said thermal sleeve being welded onto the inside of said main pipe at its root, comprising:

cooling water feeding means for supplying cooling water into said double pipe;

a restraining ring fitted externally onto the outer surface of said main pipe at a position corresponding to said thermal sleeve root, said restraining ring including:

(1) a divisible load-bearing ring surrounding and fitted onto said main pipe, (2) a pair of connecting bolts for assembling and integrally unifying said load-bearing ring, (3) a metal washer defined by several segments, (4) an adjusting bolt for adjusting the degree of constraint that said metal washer gives to said main pipe, and (5) a cooling water channel provided within each division of said load-bearing ring to keep said ring at a low temperature by flowing said cooling water therethrough; and heating means for heating the outer surface of said main pipe so as to generate a temperature difference in said main pipe wall across its wall thickness direction.

6. The apparatus of claim 5, wherein said main pipe and said thermal sleeve are made of austenitic stainless steel, respectively, and said heating means includes a high-frequency induction heating coil.

7. The apparatus of claim 5, wherein said double pipe is of the type including a space defined between said main pipe and said thermal sleeve, and wherein said cooling water feeding means includes a water circulation means for circulating cooling water in said space so that the cooling water may not be stagnant in said space.

* * * * *